US006807762B1

(12) United States Patent
Edwards

(10) Patent No.: US 6,807,762 B1
(45) Date of Patent: Oct. 26, 2004

(54) STUN GUN

(76) Inventor: Christopher M. Edwards, 309 River Rd., Dayton, NV (US) 89403

( * ) Notice: Subject to any disclaimer, the term of this patent is extended or adjusted under 35 U.S.C. 154(b) by 0 days.

(21) Appl. No.: 10/688,586

(22) Filed: Oct. 17, 2003

Related U.S. Application Data

(60) Provisional application No. 60/419,641, filed on Oct. 17, 2002.

(51) Int. Cl.[7] ..... F41C 9/00

(52) U.S. Cl. ..... 42/1.08; 89/1.11; 361/232

(58) Field of Search ..... 42/1.08; 89/1.11; 361/232

(56) References Cited

U.S. PATENT DOCUMENTS

| | | | | | |
|---|---|---|---|---|---|
| 2,204,041 | A | | 6/1940 | Jefferson | 231/2 |
| 3,625,222 | A | | 12/1971 | Shimizu | 128/405 |
| 3,998,459 | A | | 12/1976 | Henderson et al. | 273/84 |
| 4,084,218 | A | * | 4/1978 | Kenney | 363/18 |
| 4,167,036 | A | | 9/1979 | Kenney | 363/61 |
| 4,688,140 | A | * | 8/1987 | Hammes | 361/232 |
| 4,719,534 | A | | 1/1988 | Ward | 361/232 |
| 4,982,645 | A | * | 1/1991 | Abboud | 89/1.11 |
| 5,086,377 | A | * | 2/1992 | Roberts | 362/102 |
| 5,103,366 | A | * | 4/1992 | Battochi | 361/232 |
| 5,282,332 | A | * | 2/1994 | Philips | 42/1.08 |
| 5,282,481 | A | | 2/1994 | Ziemer | 607/145 |
| 5,388,603 | A | * | 2/1995 | Bauer et al. | 135/16 |
| 5,457,597 | A | * | 10/1995 | Rothschild | 361/232 |
| D364,208 | S | | 11/1995 | Larson | D22/117 |
| 5,473,501 | A | * | 12/1995 | Claypool | 361/232 |
| 5,529,215 | A | * | 6/1996 | Banks et al. | 222/113 |
| 5,531,359 | A | * | 7/1996 | Winner | 222/153.11 |
| 5,654,867 | A | * | 8/1997 | Murray | 361/232 |
| 5,986,872 | A | * | 11/1999 | Chaput | 361/232 |
| 5,988,450 | A | * | 11/1999 | Cassarino | 222/192 |
| 6,022,120 | A | * | 2/2000 | Chang | 362/109 |
| 6,256,916 | B1 | * | 7/2001 | McNulty | 42/1.08 |
| 6,404,613 | B1 | * | 6/2002 | Dowling et al. | 361/232 |
| 2002/0041479 | A1 | * | 4/2002 | Hsieh et al. | 361/232 |

* cited by examiner

*Primary Examiner*—Jack Keith
*Assistant Examiner*—Troy Chambers
(74) *Attorney, Agent, or Firm*—Sierra Patent Group, Ltd.

(57) ABSTRACT

A stun gun system includes a stun gun having a housing with a first end and a second end, and an electronics package for generating a high voltage or other discharge. The first end is configured to form a handle which has a first pair of contacts and the said second end has a second pair of contacts. The stun gun system includes a first switch configured in a first position and the electronics package, is electronically connected through the switch to the first pair of contacts.

5 Claims, 12 Drawing Sheets

STUN GUN

This application claims the benefit of Provisional application Ser. No. 60/419,641, filed Oct. 17, 2002.

BACKGROUND

This invention relates generally to personal security, and particularly to a portable personal protection device that may be carried to dispense an electrical shock or other electrically generated discharge to an assailant without harming the user.

Personal defense devices have been known for many years and range from simple noise makers to stun guns and devices for spraying mace or other noxious chemicals to disable or discourage an attacker. A stun gun or dispenser of a noxious chemical may be effective in stopping a determined assailant, but conventional devices of this type can also present a danger to the user. For example, a stun gun can easily be taken from a user by a skilled martial artist or determined assailant, especially someone high on drugs or suffering from other emotional disturbance. Since most attacks are carried out with little warning, it may not be possible for the victim to use a personal defense device under such conditions.

Some attempts have been made to develop personal defense devices, which possess more than one form of protection (i.e., they will emit an audible alarm and also discharge a noxious chemical or provide a disabling charge of electricity). Other devices have provided a light for use as a flashlight. However, these devices do not provide any means to make them difficult to dislodge from a holster or the hand of the user, nor do they have any means to minimize the chance that a child or assailant can discharge a disabling charge of electricity from the device if they should gain access to it. Furthermore, most devices must be turned on in advance of an attack because they are unsafe to transport in the on position, and when used, they are held in an ergonomically weak and inferior manner.

Thus is a need for a personal defense device that is immediately ready and simple and effective to use, and minimizes danger to the user. Further, there is a need for a personal defense device that is not easily dislodged from a holster or the hand of the user and that may be quickly and easily aimed.

SUMMARY

In one embodiment, a stun gun system includes a stun gun having a housing with a first end and a second end, and an electronics package for generating a high voltage or other discharge. The first end is configured to form a handle which has a first pair of contacts and the second end has a second pair of contacts. The stun gun system includes a first switch configured in a first position. The electronics package is electronically connected through the switch to the first pair of contacts. Optionally, the stun gun system's first pair of contacts are compressibly attached to the handle. The stun gun system has a first switch configured in a second position so that the electronics package is electronically connected through the first switch to the second pair of contacts. The stun gun system can have the second pair of contacts that are compressibly attached to the second end of the stun gun. The stun gun system optionally includes a second switch at the first end for testing the battery and electronics package and for warning an attacker when the first switch is in the first position and providing a visible spark across the second pair of contacts. The stun gun system may also include a dart with hypodermic needle positioned between the second pair of contacts.

In another embodiment, the stun gun system also can include a holster formed to receive the stun gun. The holster has a first opening adjacent the first end of the stun gun and a second opening parallel to an axis formed by the first end and the second end of the stun gun. A peg is attached to the holster adjacent to the position of the first switch. The peg places the first switch in the second position when the stun gun is removed from the holster through the second opening. The stun gun system further includes a switch retainer that prevents the first switch from disengaging from the first position. The stun gun system further includes a switch retainer that prevents the first switch from disengaging from the second position.

In another embodiment, the stun gun system has a housing comprising a first face and a second face. The first face accommodates the electronics package and a battery and has a plurality of screw holes for screws that hold down the electronics package and the battery. The second face has a master power switch, a first channel, and a second channel that meet at a meeting place. The meeting place has the first switch, which has a first and a second position; the first position closes an electrical circuit to the first contacts, and the second position closes an electrical circuit to the nose portion. The handle is compressibly attached to the body, and has a handgrip and two side arms. The handgrip portion has at least one exposed, stunnable contact, and is compressible, so as to impart a shock through the stunnable contact when the first switch is in the first position. A nose portion is compressibly attached to the body, and has at least one exposed contact capable of imparting a shock when the nose is compressed and the first switch is in the second position.

In yet another embodiment, a stun gun system includes a first end, second end and an electronics package. The first end is configured to form a handle. The second end is elastically attached to the first end, and forms a cylindrical body extending away from the first end. The second end has a pair of contacts, and conductive strips located along the cylindrical body. The electronics package is for generating a high voltage or other discharge, and is electronically connected to the conductive strips when the second end is pulled away from the first end. Optionally, the stun gun system's electronics package for generating a high voltage or other discharge is electronically connected to the pair of contacts when the second end is compressed toward the first end. The stun gun system further includes a button at the first end for testing the battery and the electronics package and for warning an attacker when the switch is in the second position and for providing a visible spark across the pair of contacts.

In another embodiment, a stun gun system includes a stun gun having a housing with a first end and a second end. The first end forming a handle to accommodate a hand of a user, the handle having a first set of electrodes; the second end having a second set of electrodes. It also includes a means for generating high voltage or other discharge and a means for selectively applying the high voltage or other discharge between the first or second set of electrodes. It also includes a means for triggering and disabling the first and second set of electrodes and a means for triggering the second set of electrodes when the user pulls the device from the user's holster. The stun gun system optionally includes means for triggering the first set of electrodes when the device is improperly pulled from the user's holster. The stun gun system optionally includes means for testing the stun gun. The stun gun system optionally includes means for delivering a sedative or other drug. The stun gun system further includes means for holstering the stun gun. The stun gun system's holstering means can include a means for selectively placing the switch in the first position. The stun gun system's holstering means may include a means for selectively placing the switch in the second position.

In yet another embodiment, a method for preventing the unauthorized use of a stun gun system includes providing a stun gun with a handle and a nose, a first set of electrodes on the handle, a second set of electrodes on the nose. The system also provides a holster, a first opening in the holster, a second opening in the holster; and provides for securing the stun gun in the holster. Lastly, the system also provides a high voltage or other discharge to the handle, removing the stun gun through the second opening, and delivering the high voltage or other discharge to the second set of electrodes.

BRIEF DESCRIPTION OF THE DRAWING FIGURES

DETAILED DESCRIPTION

Figure 1:
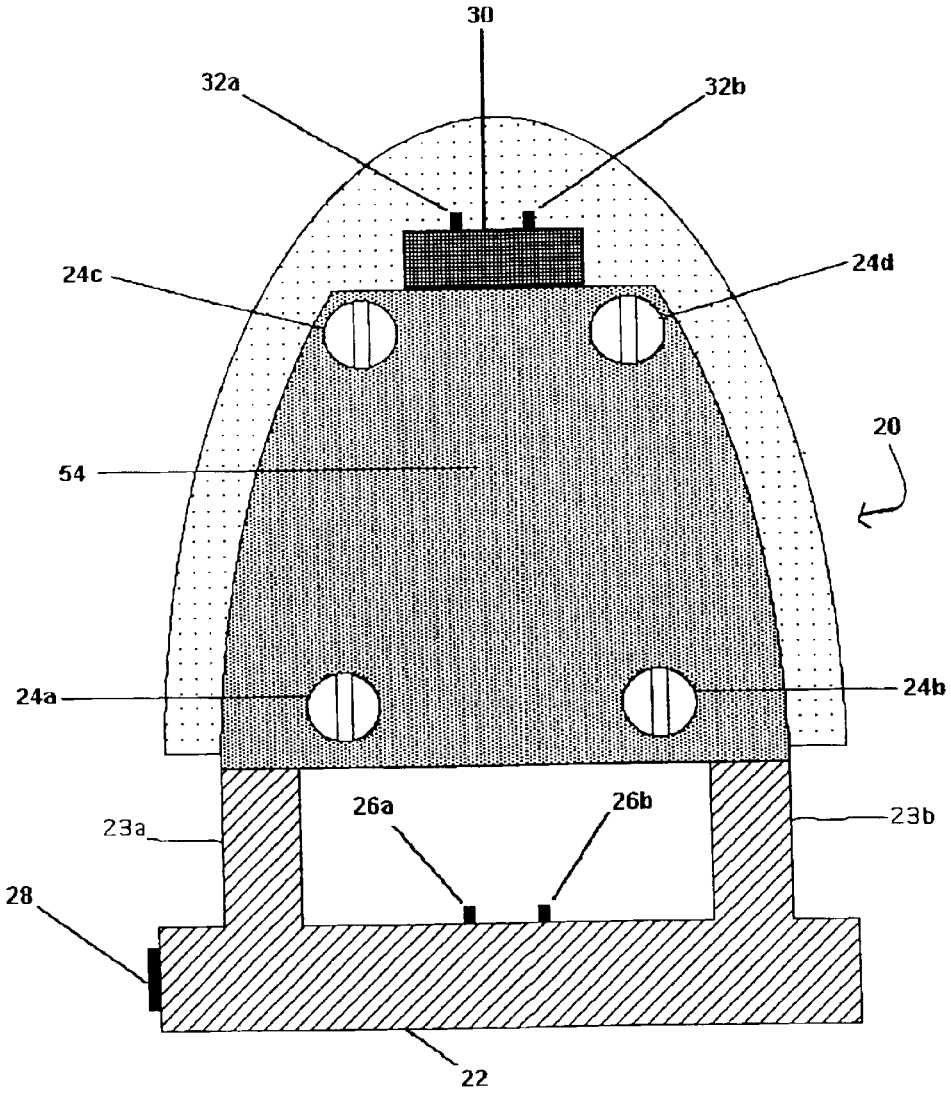
FIG. 1 is an overview of an exemplary stun gun looking at the battery side and showing an outline of the holster.

Referring to the drawings in more detail, a personal security device in accordance with the invention is indicated generally at 20 in FIG. 1. The stun gun 20 comprises a hollow housing having an oval shape, with a handgrip 22 and four screws 24*a*, 24*b*, 24*c*, 24*d*, which hold together the body of the stun gun and sandwich the electronic module between the battery and stun gun body and also affix the battery module 54. On the hand grip 22 are two handgrip contacts 26*a* and 26*b*. On one side of the handgrip 22 is a scare button 28, which when depressed actuates an electrical arc, which ionizes the air molecules in the gap between electrodes, producing a visible arc and loud noise. The scare button also serves as a test for the operator and as a deterrent for the assailant. Opposite the handgrip 22 is the stun-delivering part of the device, with a nose contact housing 30, with its two nose contacts 32*a* and 32*b*, which are responsible for the arc, and which have a contact end (shown) and an opposite end (not shown) which act as a plug into the receptacles (not shown) of the electronic module.

Figure 2:
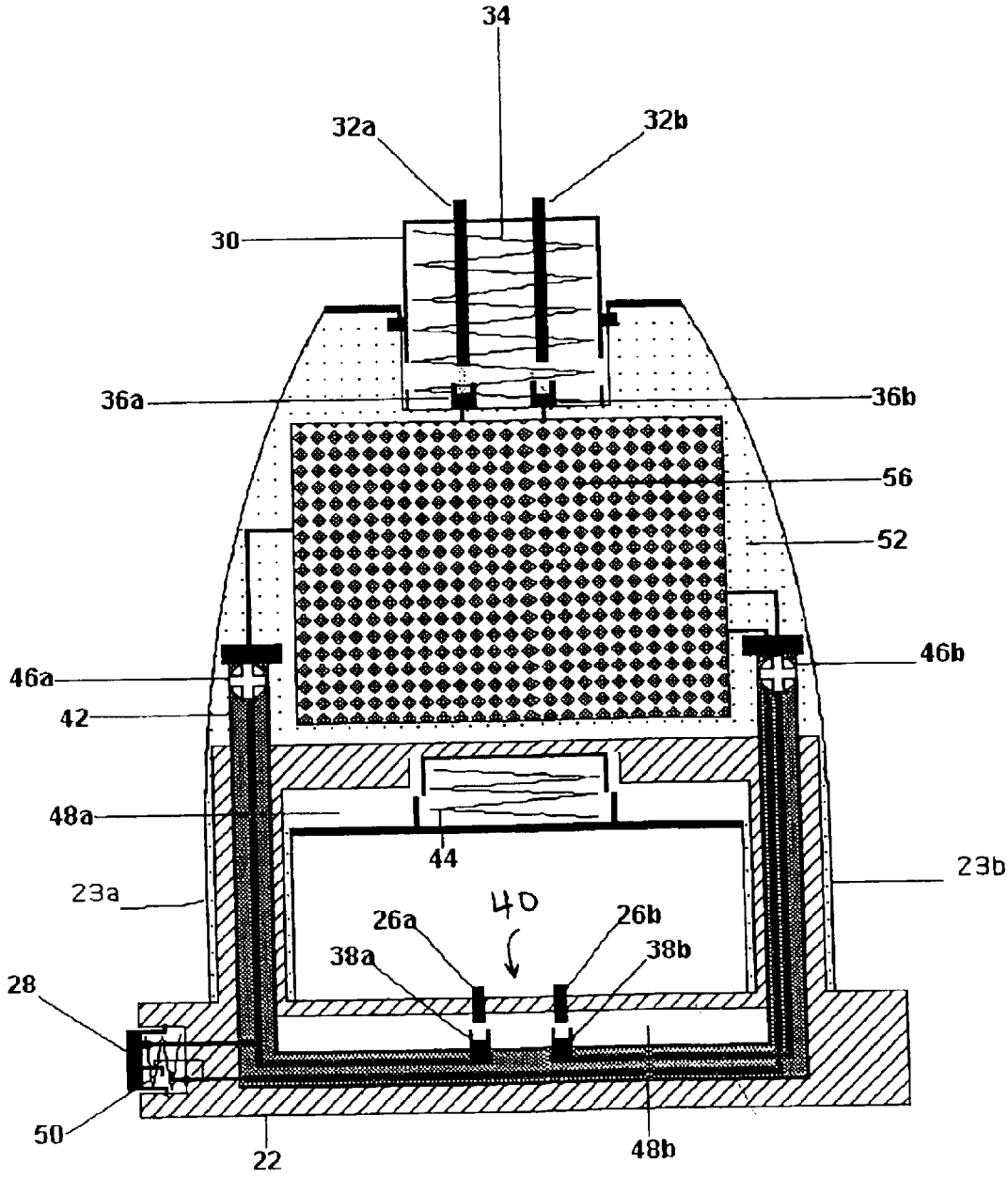
FIG. 2 is a cutaway view of an exemplary stun showing some of the internal features but not most of the electronics.

Turning now to FIG. 2, it can be seen that the nose contact housing 30 is spring 34 loaded. When the nose contacts 32*a* and 32*b* are pressed against an assailant, the nose contact housing 30 moves into the body of the stun gun and the plug end of the nose contacts connect with the electronic module receptacles 36*a* and 36*b*.

The handgrip 22 is compressed by a person gripping it and touching the two contacts 26*a* and 26*b*. On the sides of the handgrip are arms 23*a* and 23*b* which connect the handgrip to the main body and are conduits for electrical connections to the electronic module 56. When the handgrip 22 is compressed, it generates an electrical arc between the contacts 26*a* and 26*b*. When the person's hand grasps the handle and tugs opposite the nose end or outward away from the user's body (while the stun gun is holstered and the switch is in the first position), the entire hand grip module 40 with its contacts 26*a* and 26*b* is moved toward the handgrip internal anchor 42, which causes the plug end of contacts 26*a* and 26*b* to connect with electronic module receptacles 38*a* and 38*b*. This closes the current path and causes high-voltage electricity or other discharge to pass from one contact to the other through the person's hand. Accidental connection of the plugs into the receptacles is avoided by means of a handgrip return spring 44. The handgrip return spring 44 is strong enough to allow lateral movement without a shock but not straight or outward movement of the handle. The hand grip internal anchor 42 is retained in place by retaining screws 46*a* and 46*b*. The exterior hand grip module 40 moves within hand grip internal anchor 42 because there are two travel channels 48*a* and 48*b* through which the exterior handgrip module 40 can move. FIG. 2 also shows the scare switch 28 and a thumb switch return spring 50, which keeps the scare switch 28 protruding when not being depressed. The design of the scare switch allows only a momentary discharge to prevent a user who holds it down in panic from burning out the circuits or wearing down the battery.

Figure 3:
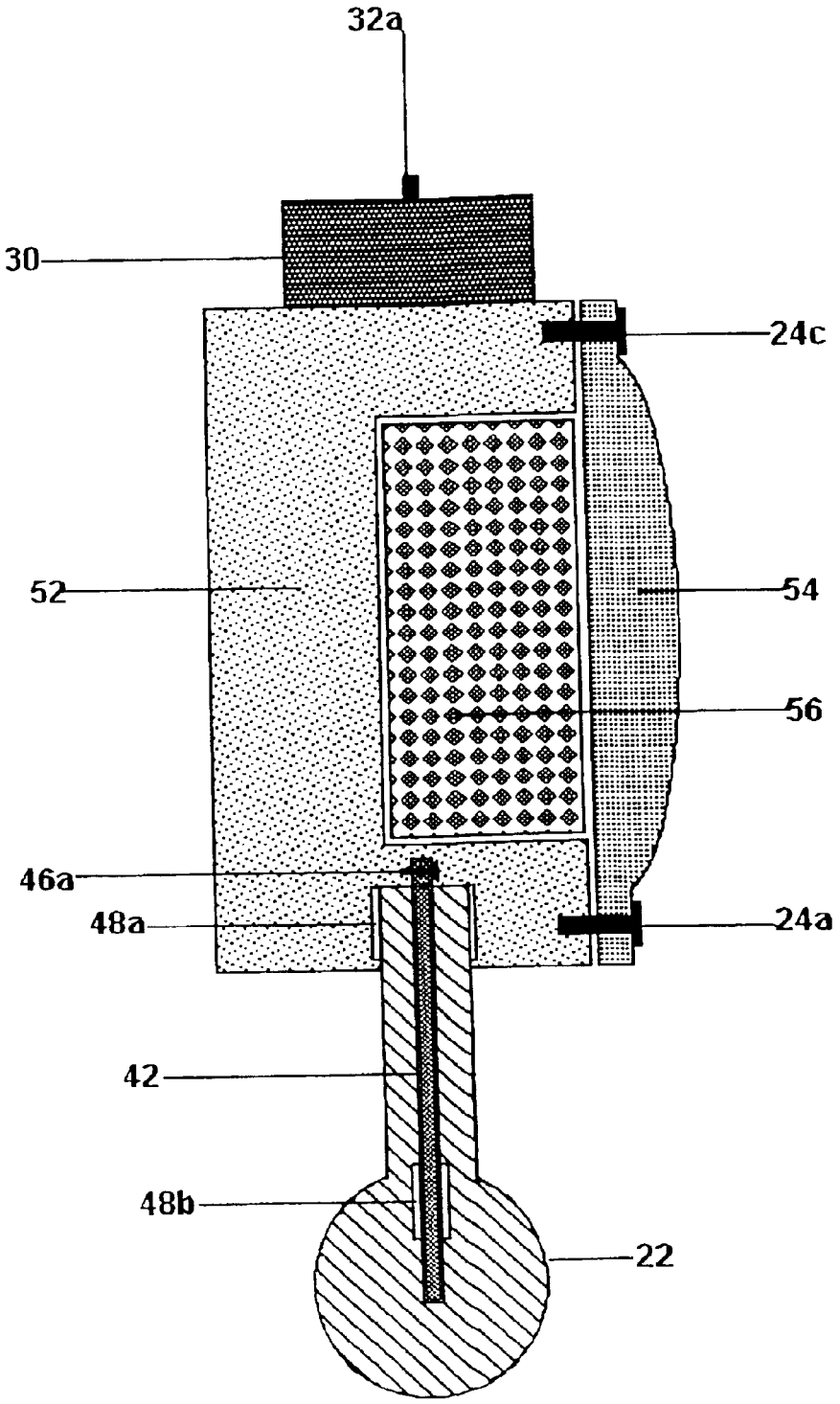
FIG. 3 is a cross section of an exemplary stun gun, indicating the location of the battery and electronics.

FIG. 3 is a cross section from the nose contact 32*a* to the handle 22, which illustrates the main body 52 of the stun gun and possible locations of the replaceable battery 54 and replaceable electronics module 56. The replaceable nature of these modules allows any future developed battery technology or electrical discharge technology to be used as an upgrade to the stun-gun.

Figure 4:
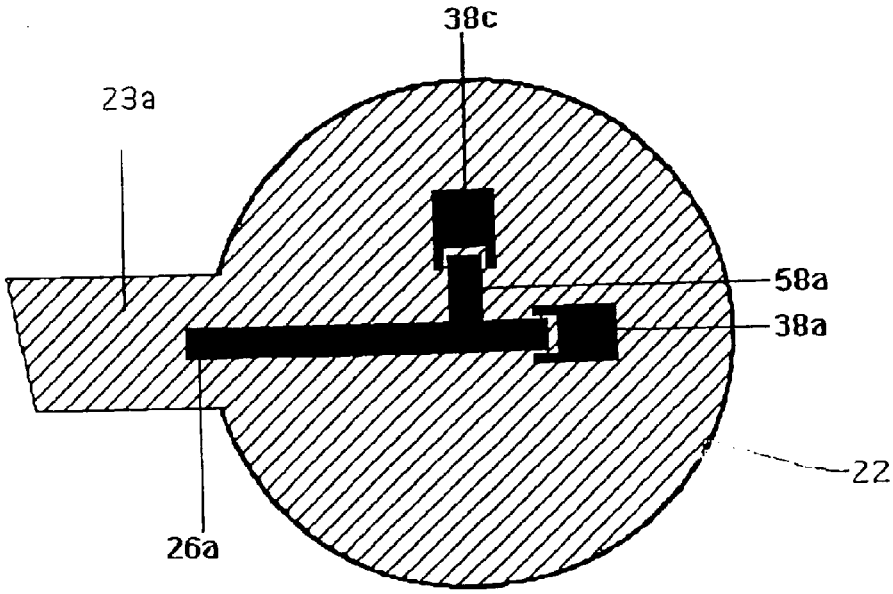
FIG. 4 is a cross section of an exemplary handle from the side of the thumb-operated alarm switch, emphasizing the handgrip contacts.

FIG. 4 shows a cutaway view looking inside the handle grip 22 from the scare button 28 end. Also visible are hand grip contact 26*a* and electronic module handgrip receptacles 38*a* and 38*b*. This shows that if an assailant attempts to grab the handle 22 to pull the stun gun straight out of the holster (see below), electronic module handgrip receptacle 38*a* is contacted to permit electricity to flow to handgrip contact 26*a*. Also shown is electronic module handgrip receptacle 38*b* which connects with side arm 58*a* when an assailant attempts to pull the stun gun away from the owner's body, thus acting in an identical manner to receptacle 38*a*.

Figure 5:
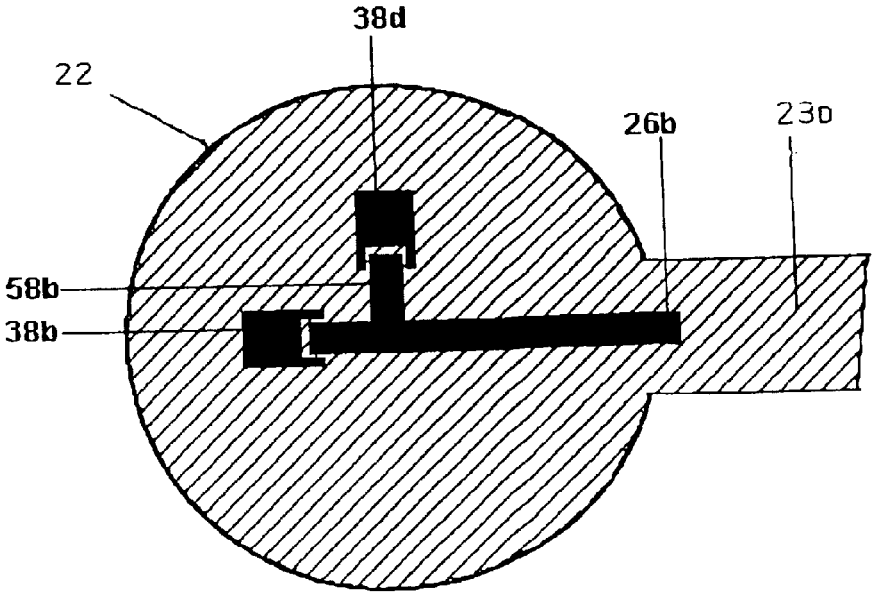
FIG. 5 is a cross section of the exemplary handle at the side opposite the thumb-operated alarm switch, showing the second hand grip contacts.

FIG. 5 is a cutaway view looking inside the handle grip 22 in the opposite direction from that in FIG. 4 above. Also visible are hand grip contact 26*b* and electronic module handgrip receptacles 38*c* and 38*d*. These receptacles work the same as their counterparts shown in FIG. 4.

Figure 6:
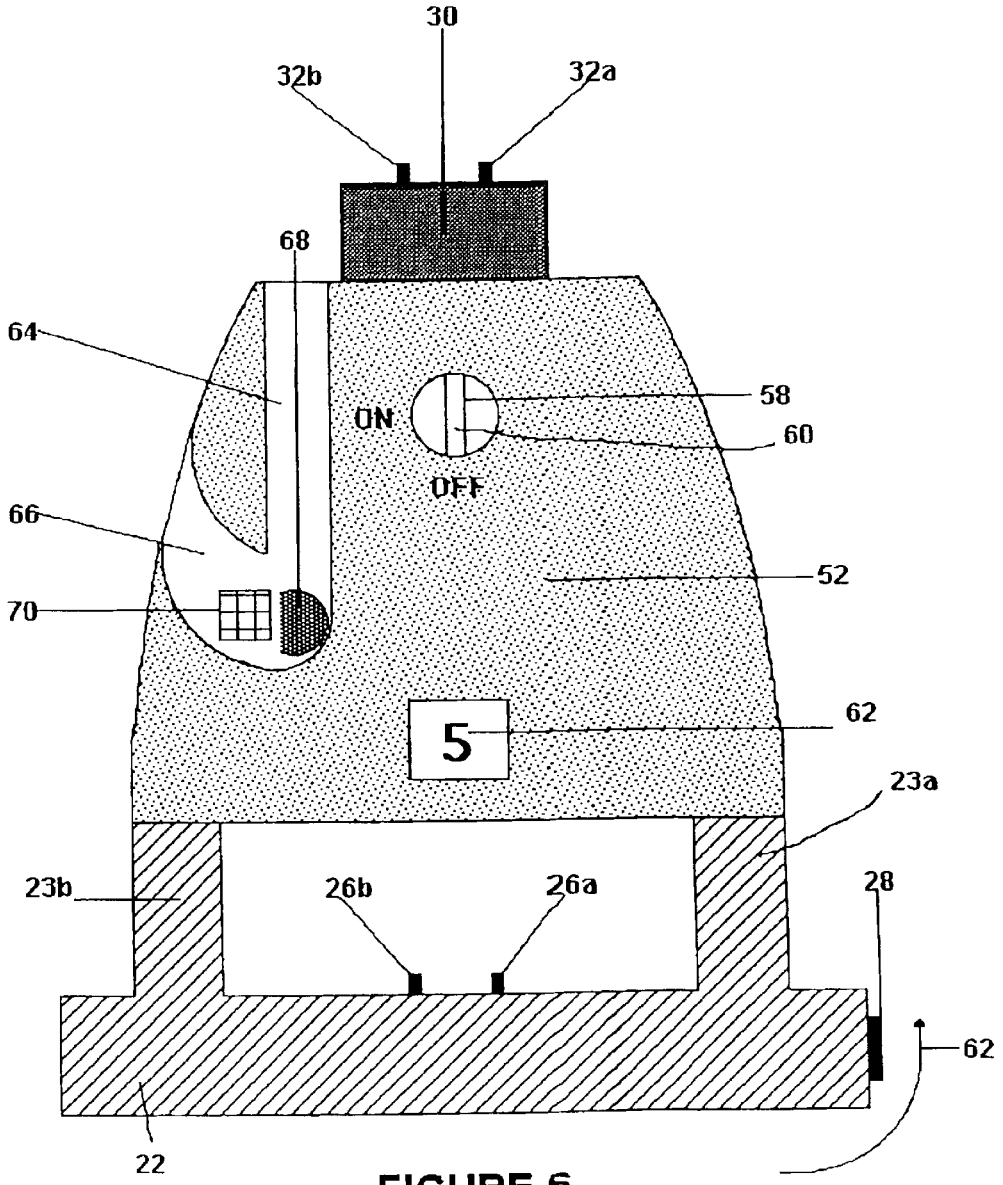
FIG. 6 is a view of the switch side of an exemplary stun gun.

FIG. 6 is a view of the switch side of the stun gun. Master power switch 58 is rotated to turn on or off and has a central indentation 60 to accommodate a coin for turning. An optional indicator 62 shows the number of remaining effective shocks. This can be viewed conveniently without twisting the arm. Also shown on the switch side of the stun gun is a holstering channel 64, indicating that the stun gun is inserted straight down into the holster. The withdrawing channel 66 is at an angle from the holstering channel 64, so that when the stun gun is withdrawn in a breakout clockwise motion (see lower right arrow 62), it is released from the holster peg capture hole 68 and the holster peg slides the peg switch 70. When the stun gun is in the holster (see below), the peg switch 70 is in a position such that the handle 22 if grasped and tugged improperly stuns and the nose contacts can not receive electricity.

Figure 7:
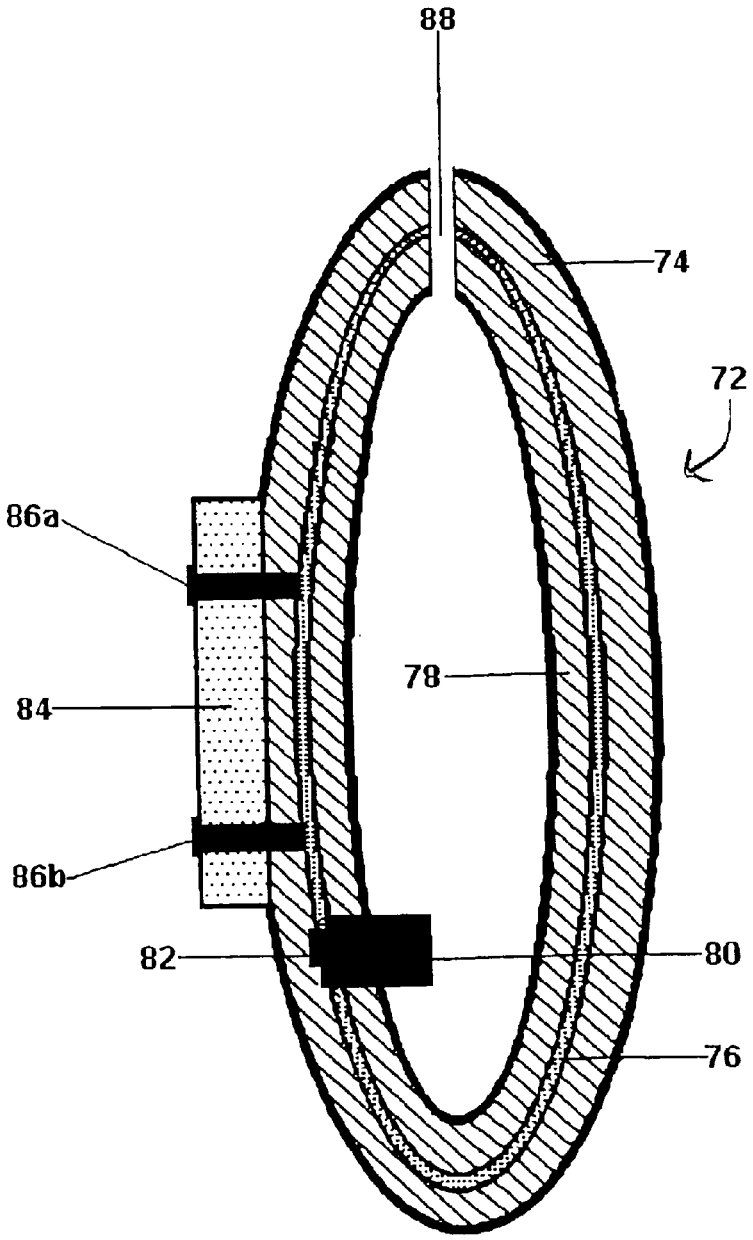
FIG. 7 is a cross section view of an exemplary holster.

FIG. 7 is a cross section of the holster 72, which has an outer shell 74, an internal clam spring 76 and an inner lining 78. The holster 72 also has an internal peg 80 held in place by the holster peg retaining screw 82. For convenient and secure carrying, for example, on the belly, the holster 72 has a belt loop 84, which is held in place by belt loop retaining screws 86*a* and 86*b*. The holster 72 has a side opening 88 for quickly withdrawing the stun gun and simultaneously making ready the nose contacts in the same motion, without manually moving an on-off switch as is commonly found in the prior art and commercially available stun-guns in use today. Note that the holster 72 is symmetrical and should be designed with the side opening 88 disguised. Then an assailant would believe that the stun gun 20 must be withdrawn straight out of the holster and will stun himself by grasping and tugging the stun gun 20.

Figure 8:
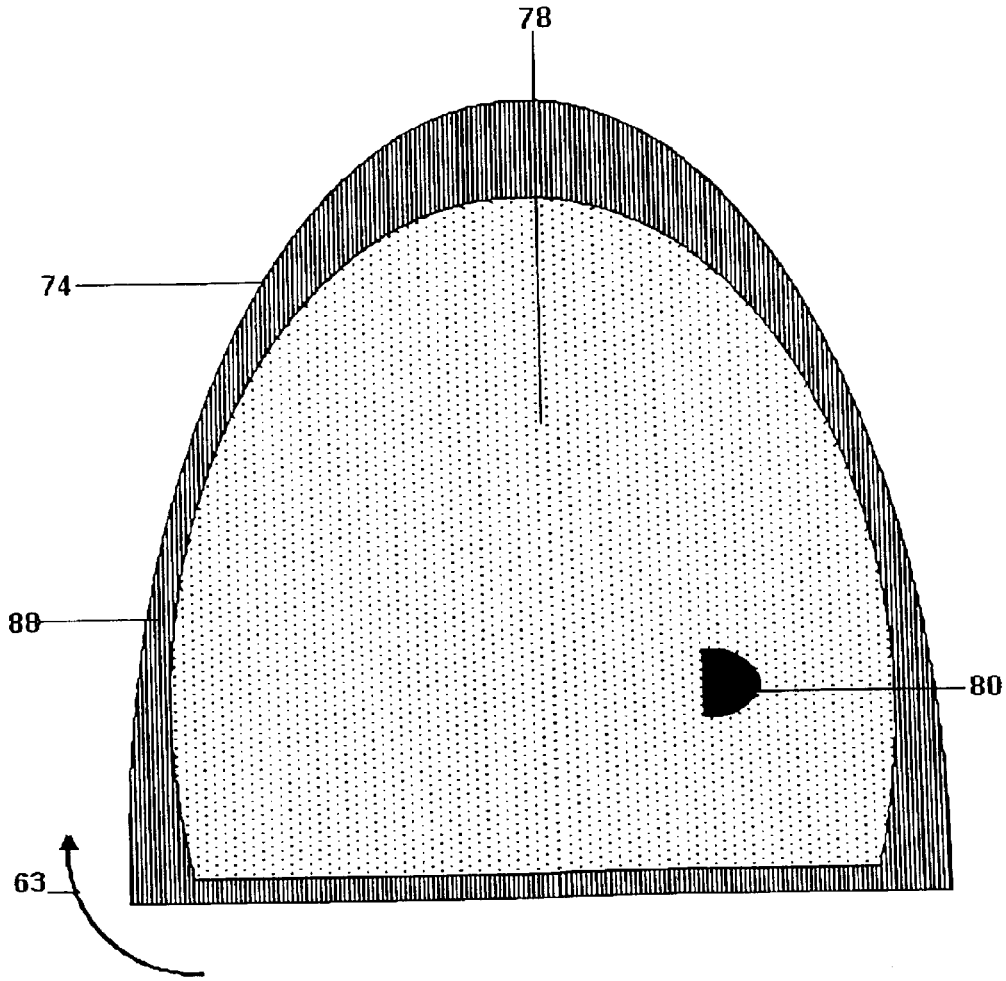
FIG. 8 is a cutaway view, showing the inside of the back or stun-gun switch side of the holster.

FIG. 8 is a cutaway view, showing the inside of the back or body side of the holster 72, which fits with the switch side of the stun gun. Holster 72 has an open side 88, holster outer shell 74, and holster inner lining 78. This figure also shows the location of the holster peg 80 and the direction of a proper draw 62.

Figure 9:
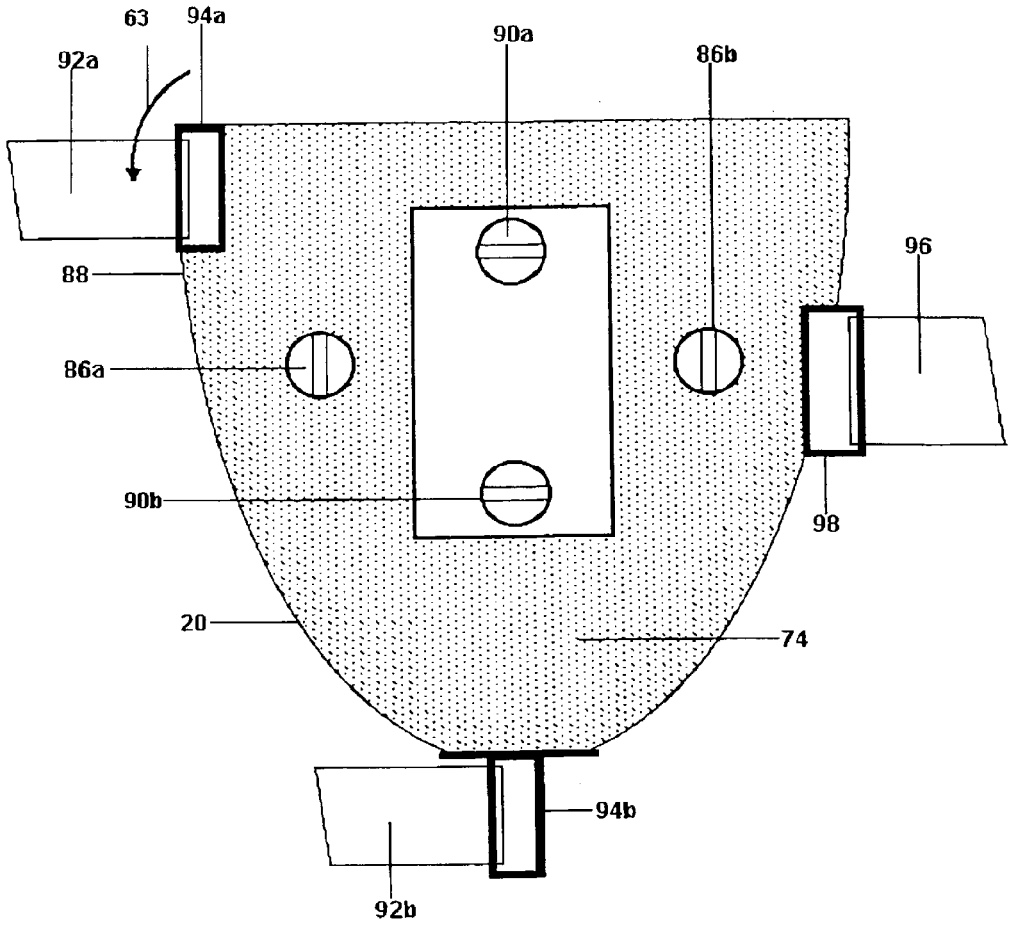
FIG. 9 shows the view of another exemplary embodiment of the holster on the outside rear or body side of the holster.

FIG. 9 shows the rear view of another embodiment of the holster 72, with holster belt loop 84 and belt loop retaining screws 86*a* and 86*b*. There are two optional, additional belt loop screws 90*a* and 90*b*. The belt loop retaining screws are positioned to permit the holster to be worn sideways at the belly or on the hip. Another option to secure the holster and stun gun to the operator is as a shoulder holster. In this embodiment the holster has three additional straps and loops. The shoulder straps 92*a* and 92*b* are attached to the holster via shoulder strap loops 94*a* and 94*b*. There is an additional belt hold down strap 96 attached to the bottom of the holster 72 via belt hold down strap loop 98. These additional straps are so positioned to permit the holster 72 to be worn in the arm pit and further secured to the operator's belt with belt hold down strap 96.

Figure 10:
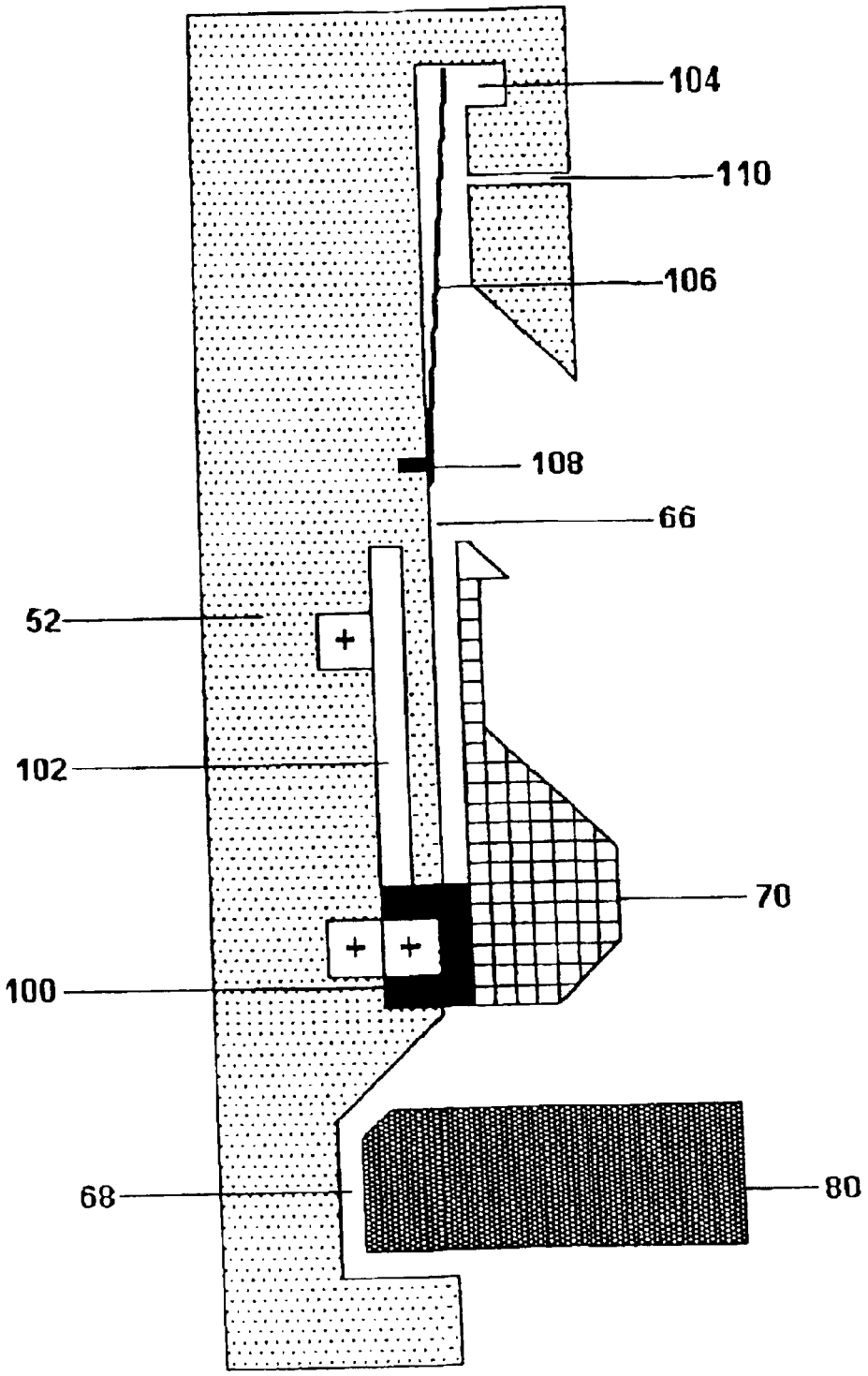
FIG. 10 shows a cross-sectional view of the main body of the exemplary stun-gun and the internal peg.

FIG. 10 is a detailed cross section illustrating the action of the peg switch 70 and the holster peg 80. The peg switch 70 sits on the peg switch anchor 100 which moves in the anchor groove 102. The anchor groove 102 optionally contains a spring (not shown) which returns the peg switch 70 to the position shown. When the stun gun 20 is properly removed from the holster 72, the holster peg 80 pushes peg switch 70 to the left into a hole 104, depressing peg switch lock-in spring 106, which is fixed in place with spring retaining screw 108. In this position, electricity can flow to the nose contacts (once they are pressed against an assailant) and not to the handle. Once the incident is over, the peg switch 70 can be removed from hole 104 by inserting a paper clip into the peg switch reset hole 110. Then the peg switch 70 can be moved manually back to the position pictured, or a spring (not shown) in the anchor groove 102 can push the peg switch back to the position pictured. The operator can leave the peg switch in its hole if it is desired to disable handle contacts (to use with or without the holster) yet keep the nose contacts immediately activatable.

Figure 11:
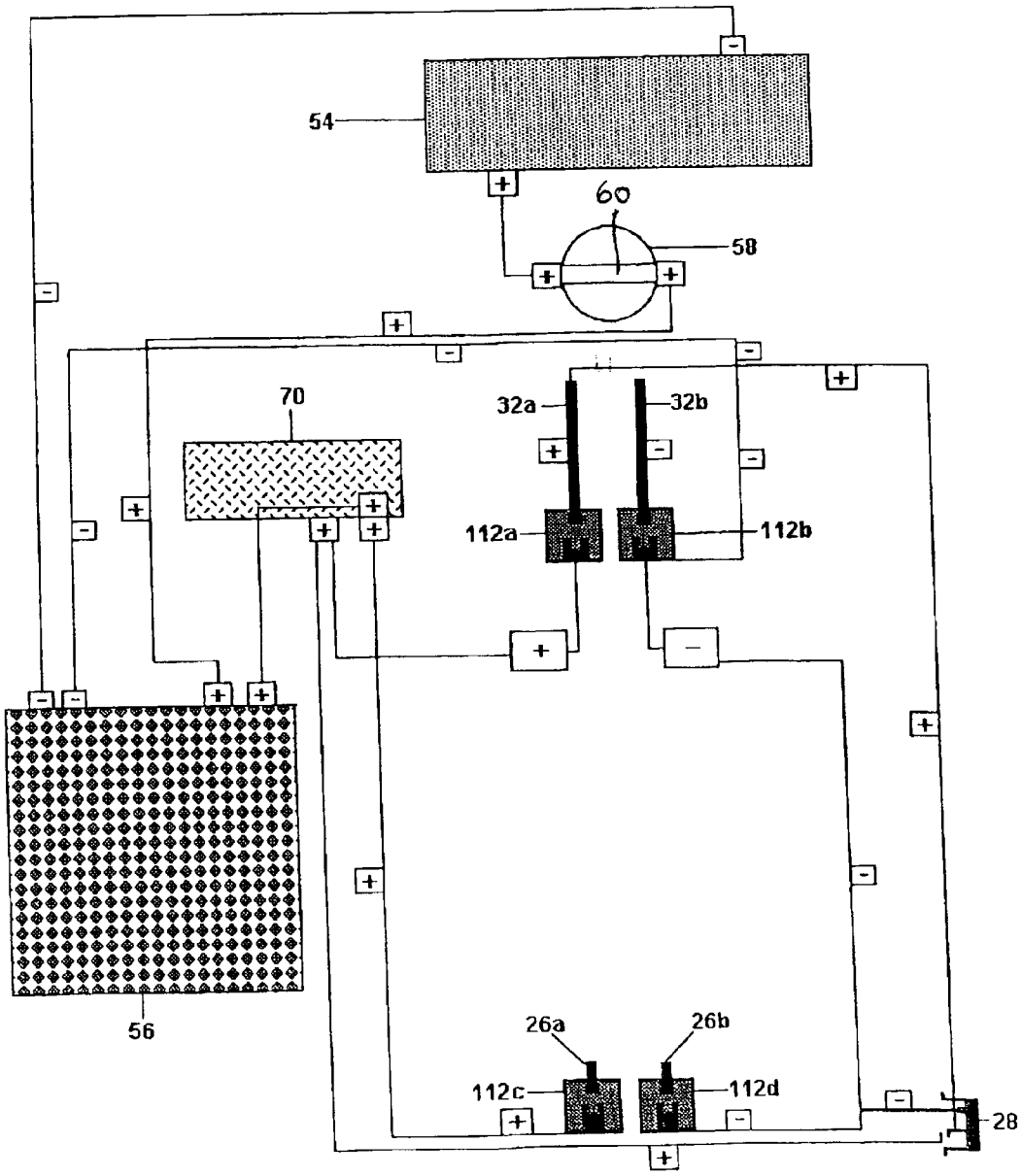
FIG. 11 shows exemplary circuitry of the stun gun.

FIG. 11 is a schematic of the wiring of the inventive stun gun. Starting at the upper right, there is a battery 54 which can comprise at least one battery or a rechargeable battery. This is connected to an on-off switch 58 which is rotated by means of a coin in the coin indentation 60. The switch 58 is usually left in the on position so that electricity flows to the electric shock unit 56. The electric shock unit 56 includes multiple transformers that boost the voltage in the circuit, typically to between 50,000 and 625,000 volts and reduce the amperage. It also includes an oscillator that fluctuates current to produce a specific pulse pattern of electricity. This current charges a capacitor that builds up a charge and releases it to either the handle contacts 26*a* and 26*b* or to the nose contacts 32*a* and 32*b*. The two sets of electronic module receptacles are insulated 112*a*, 112*b*, 112*c* and 112*d* to prevent internal leakage of current. The peg switch 70 can be seen to direct current either to the handle contacts 26*a* and 26*b* or to nose contacts 32*a* and 32*b*.

Figure 12:
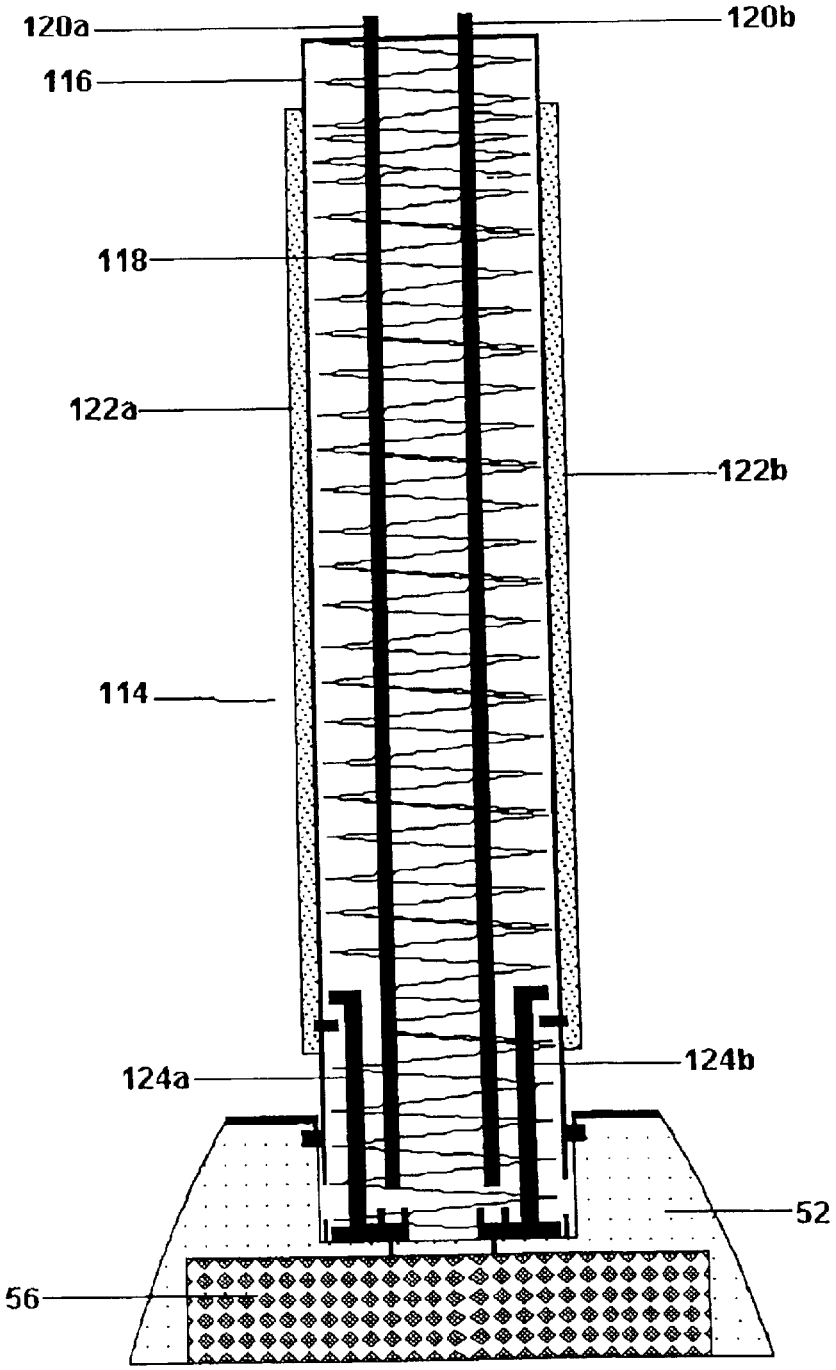
FIG. 12 shows an exemplary spring-loaded baton extension with contacts and conductive strips which may be attached to the stun gun.

FIG. 12 shows another embodiment of the inventive stun gun 20. This version has a long baton rather that the short nose. The baton housing 116 encompasses the baton return spring 118, baton return spring retaining screws 118*a* and 118*b*, and the longer baton nose contacts 120*a* and 120*b*. In addition, the baton has two lateral, longitudinal contact strips 122*a* and 122*b*. If the assailant grabs the sides of the baton and pulls (as if to disarm the owner), he will receive a shock from the contact strips 122*a* and 122*b*, whose electricity or other discharge comes through the electronic module baton circuit extensions 124*a* and 124*b*. Alternately, when the owner firmly presses against the assailant with the baton nose contacts 120*a* and 120*b*, the baton nose contacts plug ends connect with the electronic module receptacles in the base of the baton and the assailant is stunned. The baton housing 116 must be hard enough to withstand a blow. The baton housing 116 can have longitudinal indentations to hold the baton contact strips 122*a* and 122*b*.

Figure 13:
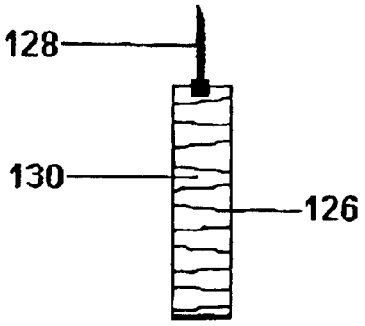
FIG. 13 shows an exemplary tranquilizer dart.

FIG. 13 shows another embodiment to disable an assailant. This comprises a collapsible dart 126, with a hypodermic needle 128 and contents 130. Suitable contents 130 can comprise a tranquilizer or other solution to disable the assailant. Alternately, in military hand-to-hand combat or covert operations the solution could be a fast acting lethal poison.

Figure 14:
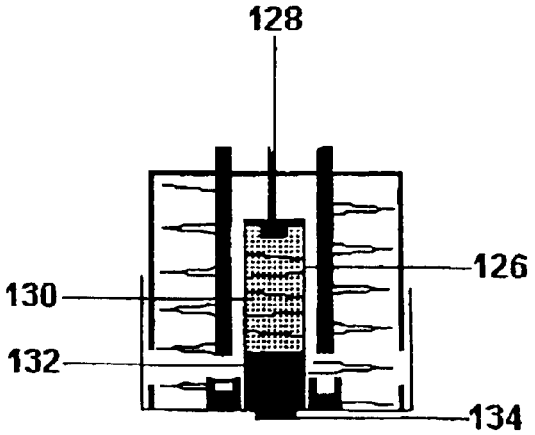
FIG. 14 shows an exemplary tranquilizer dart mounted within the stun gun's retractable nose section.

FIG. 14 shows the dart 126 within the nose of a stun gun 20. Simultaneously, the owner can shock the assailant and administer a tranquilizer. This combination is very beneficial because the electrical current can temporarily disable the assailant and the dart contents 130 can provide longer lasting disablement. The dart 126 is held in place by a dart anchor 132, which in turn is secured by a fastener such as a retaining screw 134.

Figure 15:
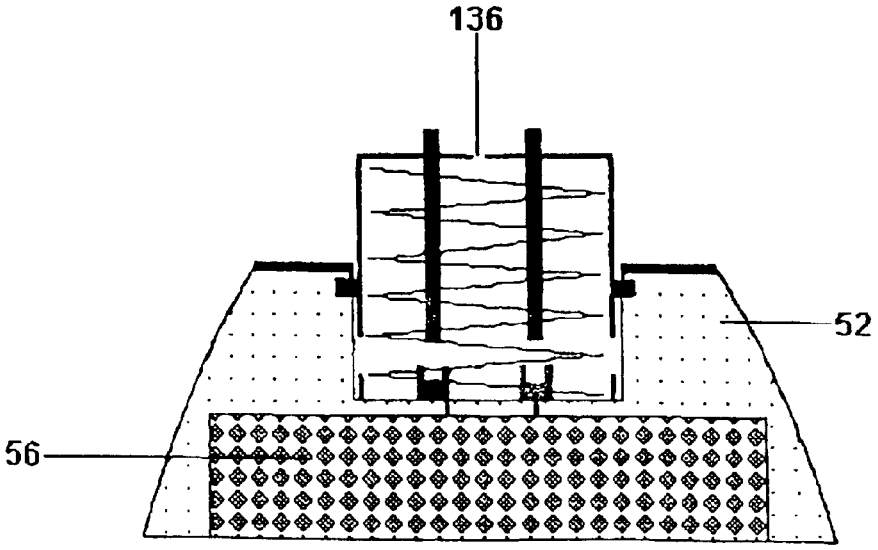
FIG. 15 shows an exemplary retractable nose section with a small hole to accommodate the needle of the tranquilizer dart.

FIG. 15 shows the stun gun tip with a small hole 136 to accommodate the needle of the tranquilizer dart.

Besides a hypodermic, the hollow nose or baton can contain tear gas, pepper spray or an identifying dye. The baton could also house a barrel which could contain a bullet or shot gun shell.

Although the invention has been illustrated and described in detail herein, it is to be understood that various changes and modifications may be made therein without departing from the spirit and scope of the invention as defined in the appended claims.

What is claimed is:

1. A stun gun system comprising;

a stun gun having a housing with a first end and a second end opposite said first end and an electronics package coupled to said housing, said electronics package configured for generating a high voltage, said first end configured to form a handle, said handle having a first pair of contacts, said second end having a second pair of contacts configured for releasing an electrical charge;

a first switch coupled to said handle configured in a first position; and said electronics package, being electronically connected through said first switch to said first pair of contacts.

2. The stun gun system of claim 1 further comprising:

a holster formed to receive said stun gun, said holster having a first opening adjacent said first end of said stun gun and a second opening parallel to an axis formed by said first end and said second end of said stun gun;

a peg attached to said holster adjacent the position of said first switch, said peg placing said switch in said second position when said stun gun is removed from said holster through said first opening.

3. The stun gun system of claim 2 wherein said peg is configured to place said first switch in said second position when said stun gun is removed from said holster through said second opening.

4. The stun gun system of claim 2 further comprising:

a switch retainer, said switch retainer configured to prevent said first switch from disengaging from said first position.

5. The stun gun system of claim 2 wherein said housing comprises a first face and a second face, said first face contains said electronics package and a battery, said first face having a plurality of screw holes for screws which hold down said electronics package and said battery, said second face having a master power switch, a first channel and a second channel which meet at a meeting place, said meeting place including said first switch, said first switch having said first and said second position, said first position closing an electrical circuit to said first contacts on said handle and said second position closing an electrical circuit to said second contacts on a nose portion proximate said second end, said handle compressibly attached to said body, said handle having a handgrip and two side arms, said handgrip having at least one exposed stunnable contact, said handgrip being compressible, said handgrip configured to impart a shock through said stunnable contact when said first switch is in said first position, said nose portion being compressibly attached to said body, said nose portion having at least one exposed contact capable of imparting a shock when said nose portion is compressed and said first switch is in said second position.

* * * * *